US005566695A

United States Patent [19]

Levey et al.

[11] Patent Number: 5,566,695

[45] **Date of Patent: *Oct. 22, 1996**

[54] MODULAR APPARATUS AND METHOD FOR CLEANING CONTAINERS

[75] Inventors: William D. Levey, Oakland; William J. Sell, Petaluma, both of Calif.

[73] Assignee: Environmental Sampling Supply, Inc., Oakland, Calif.

[ * ] Notice: The term of this patent shall not extend beyond the expiration dateof Pat. No. 5,409,545.

[21] Appl. No.: 388,376

[22] Filed: Feb. 14, 1995

Related U.S. Application Data

[63] Continuation of Ser. No. 27,115, Mar. 4, 1993, Pat. No. 5,409,545.

[51] Int. Cl.[6] ..... B08B 3/02; B08B 9/08

[52] U.S. Cl. ..... 134/83; 134/167 R

[58] Field of Search ..... 134/22.18, 24, 134/25.4, 46, 49, 50, 56 R, 57 R, 68, 72, 83, 129, 131, 133, 134, 152, 167 R, 168 R, 171; 15/304

[56] References Cited

U.S. PATENT DOCUMENTS

| | | | |
|---|---|---|---|
| 743,155 | 11/1903 | Eick | 134/167 R |
| 934,870 | 9/1909 | Wolfensberger | 134/134 |
| 1,265,413 | 5/1918 | Wright | 134/49 |
| 1,400,894 | 12/1921 | Mason | 134/49 X |
| 1,940,615 | 12/1933 | Webster | 134/167 R |
| 2,522,310 | 9/1950 | Smith | 134/168 R X |
| 2,522,912 | 9/1950 | Weiss | 198/803.15 X |
| 2,681,872 | 6/1954 | McCabe | 134/23 |
| 2,947,311 | 8/1960 | Fox et al. | 134/133 X |
| 3,129,713 | 4/1964 | Read | 134/73 |
| 3,302,655 | 2/1967 | Sasaki | 134/79 |
| 3,985,226 | 10/1976 | Noren | 134/133 X |
| 4,010,774 | 8/1977 | Fischer | 134/167 R X |
| 4,125,120 | 11/1978 | Standley | 134/171 X |
| 4,154,624 | 5/1979 | Wahl et al. | 134/10 |
| 4,512,811 | 1/1985 | Binnig et al. | 134/10 |
| 4,667,690 | 5/1987 | Hartnig | 134/62 |

FOREIGN PATENT DOCUMENTS

| | | | |
|---|---|---|---|
| 1077818 | 5/1954 | France | 134/171 |
| 708561 | 7/1941 | Germany | 134/83 |
| 16447 | 1/1982 | Germany | 134/167 R |
| 278223 | 11/1964 | Netherlands | 134/167 R |
| 357398 | 9/1931 | United Kingdom | 134/83 |

*Primary Examiner*—Philip R. Coe
*Attorney, Agent, or Firm*—Donald L. Beeson

[57] ABSTRACT

An apparatus and method for cleaning containers, such as sample containers for environmental testing, involves providing fluidly isolated modular cleaning bays which are interchangeably cascaded together for processing trays of containers through different washing and rinsing solutions. In each modular bay a bank of nozzle elements is cycled to traverse into and out of the tray of containers to clean the interior surfaces of the containers.

4 Claims, 16 Drawing Sheets

MODULAR APPARATUS AND METHOD FOR CLEANING CONTAINERS

CROSS-REFERENCE TO RELATED APPLICATION

This is a continuation of application Ser. No. 08/027,115 filed Mar. 4, 1993, now U.S. Pat. No. 5,409,545.

BACKGROUND OF THE INVENTION

The present invention relates to an apparatus and method for cleaning containers, and especially glass or plastic sample containers for environmental testing. The invention more particularly relates to an automated and modular cleaning apparatus and method which consistently removes impurities from the interior surfaces of sample containers, and which at the same time greatly increases throughput, that is, the rate at which the sample containers can be processed.

Sample containers used in the environmental industry to perform chemical analysis must be thoroughly cleaned before reuse in order to meet rigorous standards of cleanliness set by the U.S. Environmental Protection Agency (EPA). Even low levels of impurities left on container surfaces after cleaning can invalidate test results performed on a sample, for example, a soil sample, which has been held in the container. To meet strict EPA cleanliness standards, sample containers have heretofore been cleaned manually. Each container is individually hand-scrubbed, usually in a non-phosphate detergent wash with tap water, and then hand-rinsed in a series of required solutions, typically in a rinsing sequence involving a nitric acid solution rinse, a deionized water rinse, and a solvent rinse, such as methylene chloride, for removing oils or grease. Manual washing processes are time intensive and often yield inconsistent results because of inattentive or fatigued workers who do not consistently swipe all the surfaces of every container.

In a known variation of the above-described manual cleaning approach, sample containers, instead of being washed by hand, are washed in a conventional industrial grade dishwasher, such as a Hobart brand washer, before they are manually processed through the required rinses. In a conventional dishwasher, a spinning spray arm beneath the inverted containers projects a wash solution and tap water rinse up into and about the containers to wash both inside and outside container surfaces. A relatively small portion of the spray emitted by the spinning spray arm actually reaches the inside of the container, and that portion that does strike the container's inside surfaces does so at low pressure and in an uncontrolled fashion. As a consequence, cleansing of the critical inside surfaces of the container tends to be incomplete and inconsistent in terms of removing impurities to required levels. A conventional washer is also a wasteful process, requiring large amounts of fluid to be emitted by the spin arm compared to the amount of fluid actually contacting the container surfaces.

U.S. Pat. No. 4,667,690 to Hartnig discloses yet another approach to washing containers, in this instance washing bottles prior to being filled by a filling machine with a liquid content such as, for example, a carbonated drink. In Hartnig, the bottles are processed on a continuous straight line conveyor system, rather than in a batch process. The rinsing cycle involves conveying the bottles in an inverted position over nozzles which are mounted on a rotating platform that is synchronized with the bottles. While this continuous process provides a more direct spray into the mouth of the inverted bottle, the spray still only reaches the inside surfaces of the bottle from a source outside the container. Thus, in Hartnig the spray is likely to reach only a portion of the interior surfaces of the container and the portions of the surfaces it does reach is reached at different angles and thus with varying degrees of effective scouring force. A cascade of fluid must be relied upon to clean a portion of the surfaces, and particularly shoulder surfaces near the neck of the container. Such limitations become particularly crucial when the cleanliness of the bottles must meet exacting EPA or similar standards.

The present invention is intended to overcome the disadvantages of existing approaches to cleansing sample containers and other types of containers. The invention improves over existing manual processes by greatly increasing throughput and providing consistent results. The invention also improves on the efficacy of existing automated and semi-automated approaches, whether involving batch or continuous processing, by providing a more direct, even, and consistent high pressure spray or fluid stream to the interior container surfaces to impart a more complete and thorough scouring action to these surfaces. The invention is uniquely adapted to handling a variety of container types and sizes, such as Boston round jars, amber wide mouth jars, round packers, cream jars, straight sided (paragon) jars, modern round (versus cylindrical round) plastic containers, and vials, and conserves fluids by efficiently directing sprays to surfaces to be cleaned in a focused manner. Finally, the invention provides for modular units that can flexibly be cascaded together to provide different cleaning, rinse and drying functions.

SUMMARY OF THE INVENTION

Briefly, the apparatus and method of the invention involves a modular apparatus and method for cleaning containers comprised of individual stand alone cleaning bays that can be interchangeably cascaded together to provide different cleaning and rinsing functions using different cleaning and rinsing solutions. For example, a modular apparatus in accordance with the invention can provide for a sequence of five cleaning bays to provide five required washes and rinses under EPA regulations as follows: a first bay can provide a detergent wash followed by a bay for a recirculated nitric acid solution rinse. Third, fourth and fifth bays in turn can provide de-ionized water rinses, a possible solvent rinse, and possibly an air dry function.

In accordance with the invention, at least two modular cleaning bays are interchangeably cascaded together with a defined first bay and end bay. Transporting means are provided for transporting a set of inverted containers along a defined container support plane and in a predetermined space relationship successfully into each modular cleaning bay from the first bay to the end bay. In each bay the containers are cleaned by a fluid stream supply means which includes at least one nozzle bank disposed below the container support plane. The nozzle bank in each bay has a set of elongated nozzle elements arranged in correspondence with the space relationship of the set of inverted containers transported into the bay. Means are provided for registering the nozzle elements with the set of containers transported into the bay and, once the nozzle elements are registered with the containers, for cycling the nozzle bank in a forward and return movement that causes the set of nozzle elements to traverse through the mouth ends of the set of containers. Fluid control means associated with each bay activates the bay's fluid supply means such that a fluid stream of a selected fluid is emitted from the bay's set of nozzle elements when the nozzle elements traverse through the set of containers to thereby clean the inside surfaces of the containers.

Each of the cascaded cleaning bays of the apparatus of the invention is fluidly isolated from the adjacent cleaning bay to prevent cross-contamination of fluids. This is preferably accomplished by providing each of the cleaning bays with an infeed and outfeed door which operatively close during the process cycles of each cleaning bay.

It is contemplated that sets of containers of a given size will be loaded onto container support trays which will be carried from one cascaded bay to the next on support rails. In its preferred embodiment, all of the cascaded cleaning bays will have at least two independently operable nozzle banks with each nozzle bank being adapted to clean different size containers. In this manner, support trays of containers of a particular size and shape can be processed by operatively selecting the nozzle bank within the cleaning bay suitable to that particular size. When support trays are subsequently loaded with container sizes and shapes different from that of a previous run, a different nozzle bank can be operatively selected.

Each of the cascaded cleaning bays can be operated under computer control wherein container support trays manually fed into the first bay are automatically sequenced through and processed by each of the successive bays. The computer control can establish bottle type to be cleaned, sequences of trays through the bays, and can initiate and control the process cycle in each bay wherein the bay's selected nozzle bank is cycled through the rows of inverted containers supported in the container support tray.

It is therefore seen that a primary object of the invention is to provide for an automated apparatus and method for cleaning containers to exacting standards, and particularly the interior surfaces of sample containers that must meet EPA standards. It is a further object of the invention to provide an apparatus and method that increases through-put while achieving consistent results, and an apparatus and method that is flexible and minimizes waste. Other objects of the invention will be apparent from the following specification and claims.

DETAILED DESCRIPTION OF THE ILLUSTRATED EMBODIMENT

The illustrated embodiment of the invention provides for a batch process in which a tray of inverted containers is processed through a series of separate cleaning bays, each of which performs a designated step in an overall cleaning process, including a washing step, various rinsing steps, and even a drying step. In each of the cleaning bays, substantially the entirety of the interior surfaces of the containers supported within the cleaning bays are subjected to a direct stream of fluid under high pressure during a process cycle which is hereinafter described in greater detail. Under computer control, trays of containers are sequentially hand-fed from a suitable loading platform into the first cleaning bay, automatically processed through each of the subsequent cascaded cleaning bays, and exited from the final bay. The apparatus, as will be seen, can be readily programmed to process different container sizes and shapes.

Figure 1:
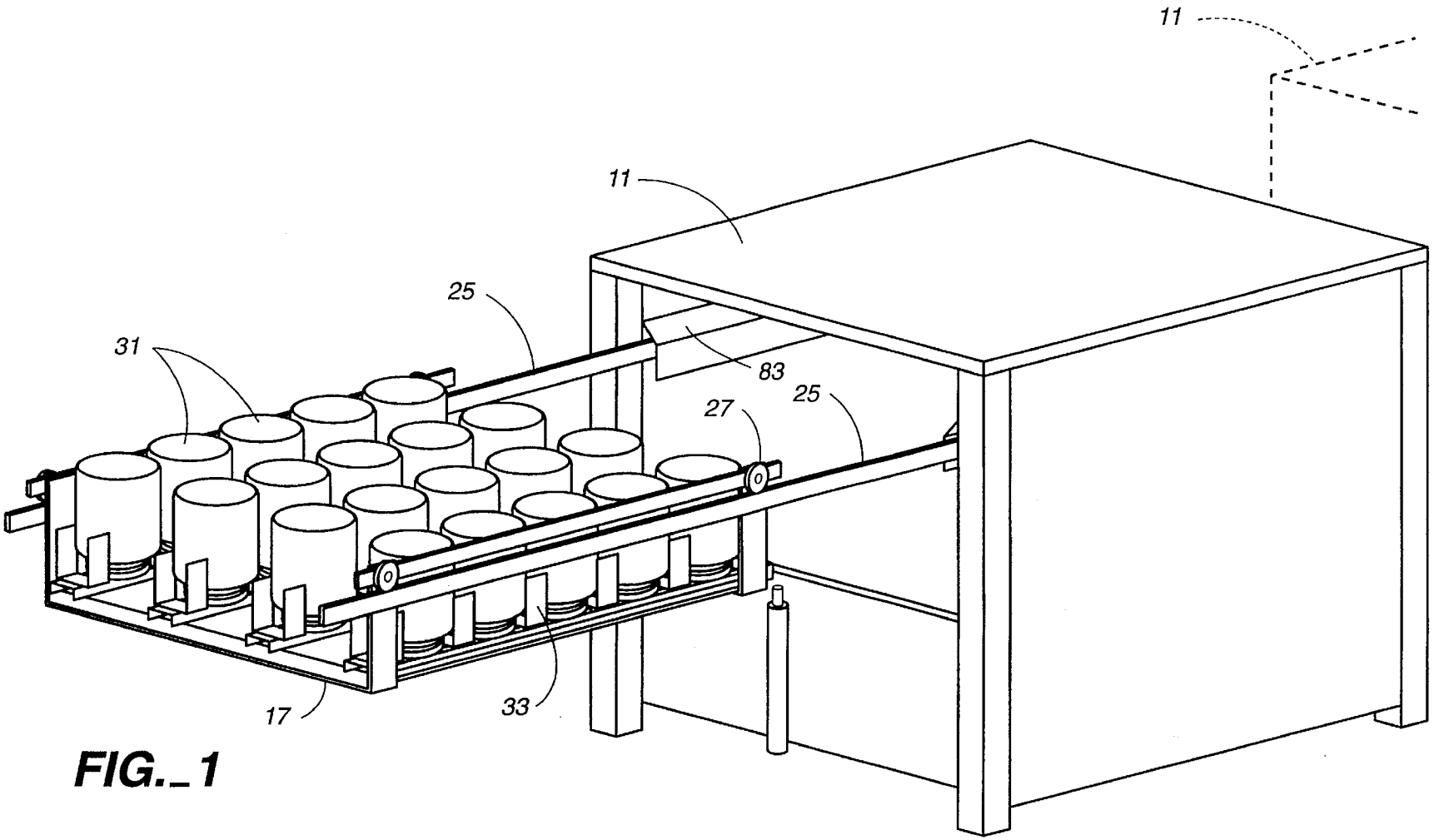
FIG. 1 is a perspective view of a cleaning bay in accordance with the invention showing a tray of containers being loaded into the bay.
Figure 4:
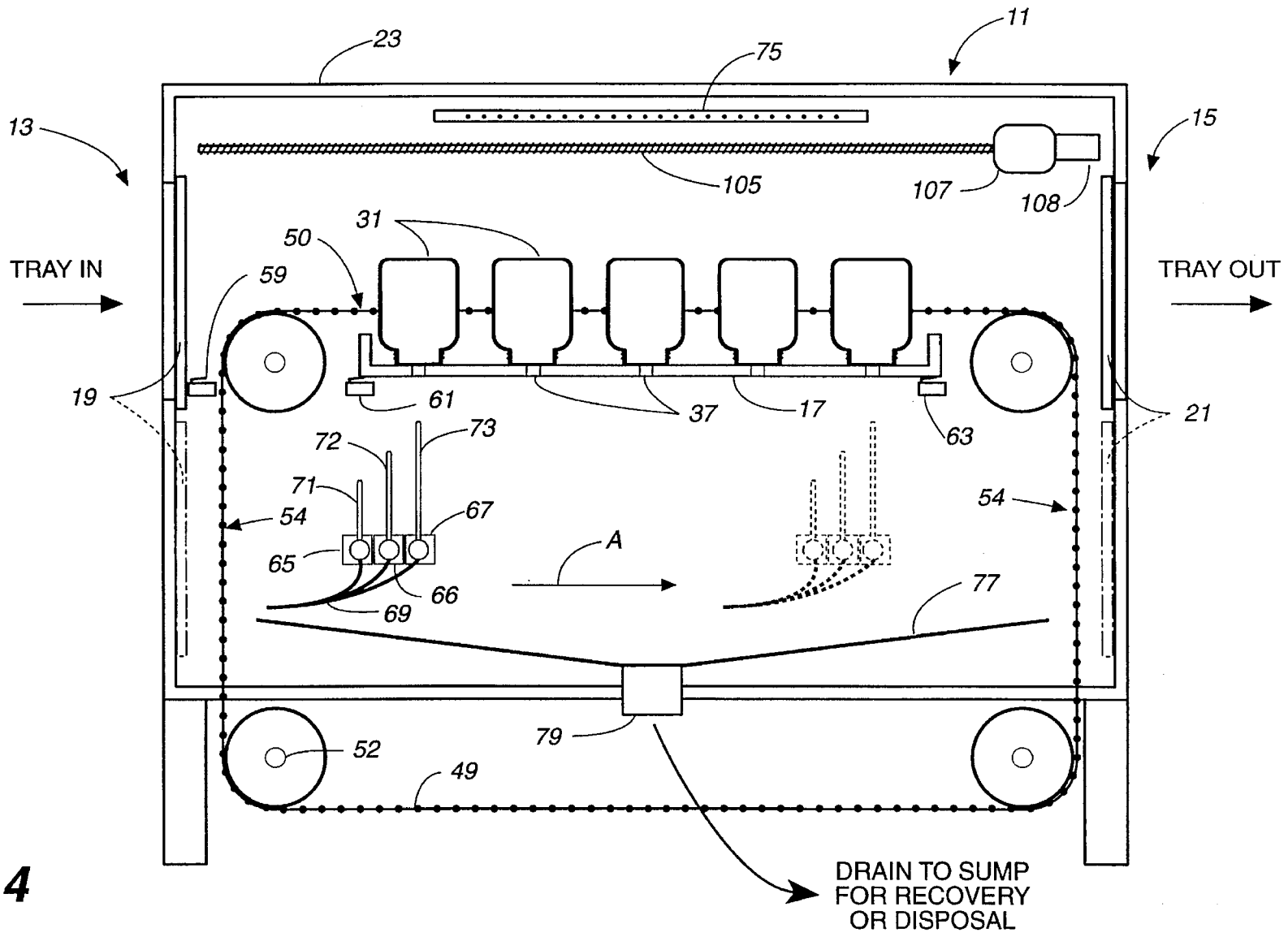
FIG. 4 is a diagrammatic view in side elevation of the interior of a cleaning bay showing the relative positioning of the container support tray and nozzle banks within the bay and the x-axis motion of the nozzle banks beneath the tray.

Referring now to the drawings, FIGS. 1 and 4 show a cleaning bay 11 having an infeed end 13 and an opposed outfeed end 15 for, respectively, receiving a tray of containers 17 into the cleaning bay and, after the containers have been processed, exiting the tray from the bay. Pneumatically actuated infeed door 19 and outfeed door 21 provide for closure of the infeed and outfeed ends of the cleaning bay when the container tray is resident within the bay. The top wall 23 of the cleaning bay can also suitably include an hydraulically actuated top door to permit convenient access to the cleaning bay for inspection and maintenance.

Figure 2:
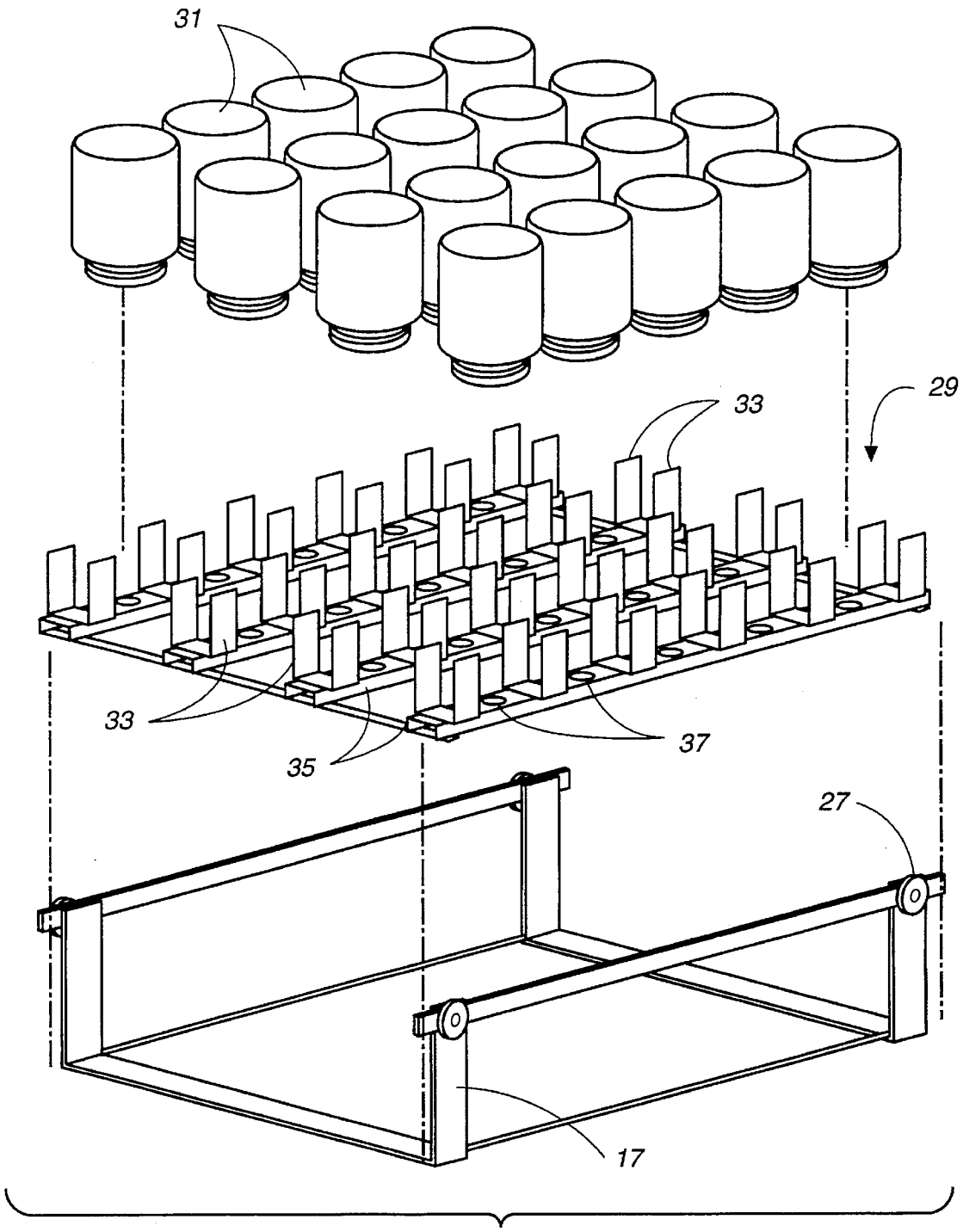
FIG. 2 is a perspective view of a tray and tray insert for supporting containers in an inverted position within the cleaning bay.

Means for supporting an array of containers of different sizes in an inverted position within the cleaning bay are illustrated in FIGS. 1–3. The container supporting means includes horizontal support rails 25 extending through the cleaning bay for movably supporting the container support tray 17 on V-rollers 27 located at the four corners of the tray. As best illustrated in FIG. 2, the support tray includes a tray insert 29 that holds an array of containers 31 in an upright, inverted position at the bottom of the tray. As best seen in FIGS. 2 and 3, the tray insert has spacer elements in the form of upright flange pairs 33 arranged in columns on elongated channel elements 35 having nozzle access holes 37 interspersed between the flange pairs. Adjacent flange pairs provide four upright contact edges, such as edges 39 in FIG. 3D, for holding a container of a given diameter over the nozzle access hole situated between the flange pairs. The known, predetermined spaced relationship of the insert's nozzle element access holes is used to position the nozzle banks as hereinafter described.

As shown in FIG. 3, a variety of different inserts can be provided to accommodate different container sizes and shapes and to allow for different spacings between containers. For example, in FIGS. 3A and 3D, the upright flange pairs 33 are spaced to accommodate a relatively large diameter bottle 41, whereas the flange pairs of FIGS. 3B and 3E accommodate an intermediate diameter jar 43. The flange pairs illustrated in FIGS. 3C and 3F, on the other hand, have relatively tightly spaced flange pairs to accommodate small diameter vials 45. In each case, the mouths 42, 44, 46 of the containers are positioned over the precisely located nozzle access holes distributed along the support channel of the insert.

Figure 3A:
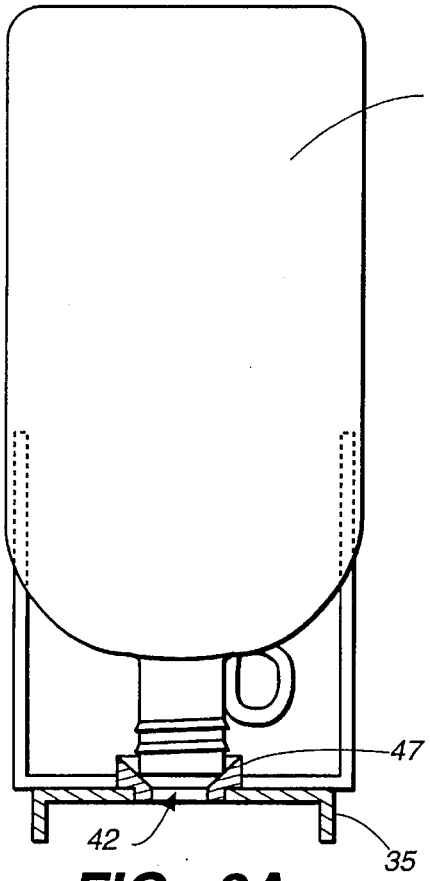
FIGS. 3A–3F show profiles of three general types of sample containers loaded onto different appropriately sized tray inserts shown both in a partial, cross-sectional front elevational view (FIGS. 3A–3C), and in fragmentary top plan view (FIGS. 3D–3F).
Figure 3B:
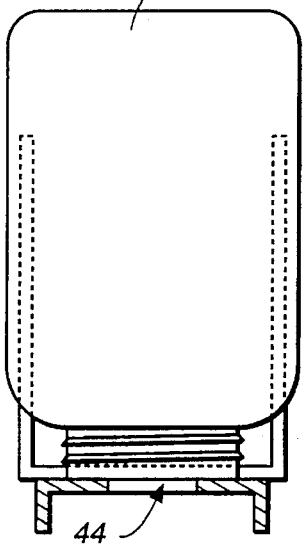
Figure 3C:
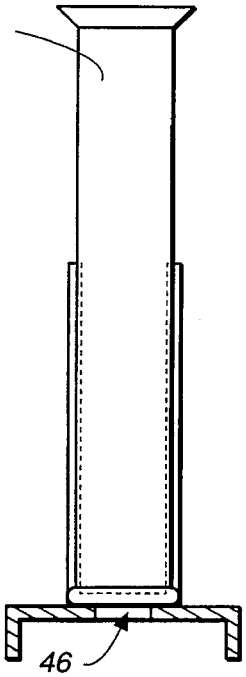
Figure 3D:
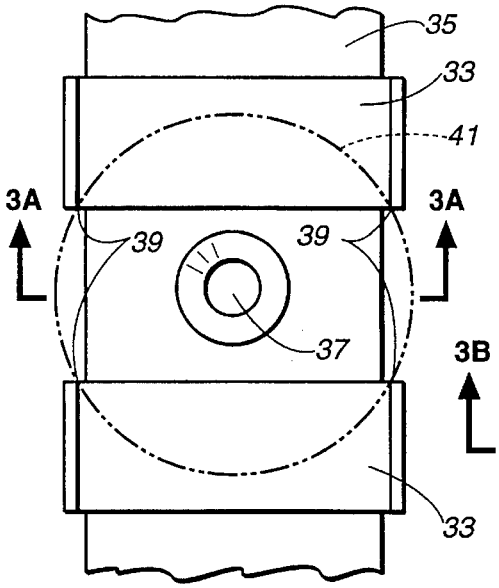
Figure 3E:
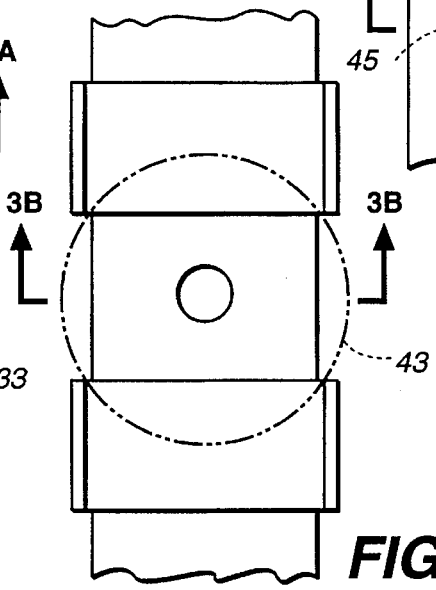
Figure 3F:
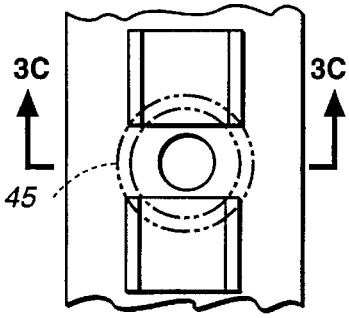

It is noted that each access hole in the insert for holding narrow mouth containers as shown in FIGS. 3A and 3D preferably has a nylon bushing 47 for seating the mouth of the container against the support channel 35. The use of such bushings will minimize the tendency of the lips of narrow mouth glass bottles to chip during processing. It is also noted that, while the inserts for simplicity could provide for the same spacing between containers for all container sizes and shapes, the inserts will preferably adjust the spacing of the containers in accordance with the container diameter so as to maximize the packing of the containers within the tray and therefore maximizing the throughput of containers. As hereinafter described, variations in the spacings between containers will require correspondingly varied spacing for the nozzle elements used to process the containers.

It is further noted that the tray and tray inserts, as well as other parts in the cleaning bay directly exposed to the fluid environment, should preferably be fabricated of corrosion resistent stainless steel.

Figure 5:
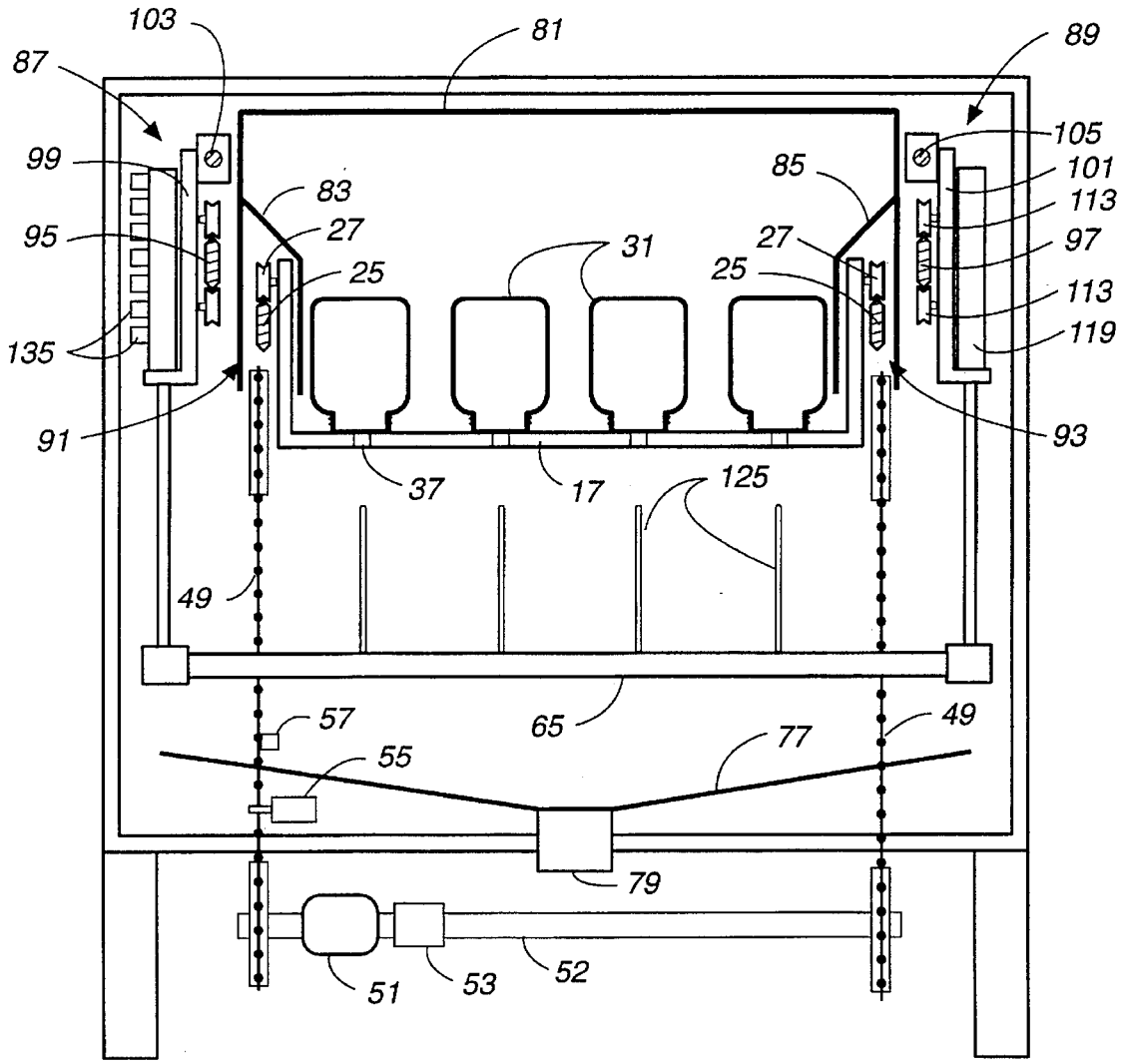
FIG. 5 is a diagrammatic endwise elevational view of the interior of the cleaning bay additionally showing the roller assembly and air cylinders which carry and operate the nozzle banks, and the tray overhead splash guard.

FIGS. 4 and 5 illustrate the means by which containers supported in a container support tray are processed through the cleaning bay. Such means includes a means for transporting the container's support tray 17 into and subsequently out of the cleaning bay through the cleaning bay's infeed and outfeed ends 13, 15, and for precisely positioning the tray in the cleaning bay where the tray holds the containers in a fixed horizontal plane for processing. The illustrated transporting means includes dual continuous loop drive chains 49, each of which travels along an upper horizontal path 50 proximate and parallel to the tray support rails 25, and each of which has a suitable tray pick-up dog (not shown) which picks up a tray of containers fed into the infeed end 13 of the cleaning bay 11 from a suitable loading platform or previous bay and which subsequently release the tray when it is exited through the outfeed end 15 of the bay. The dual drive chains are synchronously driven by drive shaft 52 and servo motor 51. An encoder 53 associated with the servo motor determines and controls the precise position of the chain, and therefore the precise position of the container support tray 17, in reference to a home position established by home position sensor 55, suitably a photodetector, which detects a flag 57 on the chain as it passes by the home position sensor. Contact switches 59, 61, 63 are additionally located within the path of travel of the tray to establish that a tray has been fed into the cleaning bay and has actually arrived at the position dictated by the sensory feedback of the encoder 53 and home position sensor 55. The first contact switch 59 is positioned proximate the infeed end 13 of the bay to signal a tray is arriving, and two additional position contact switches 61, 63 are located such that they both simultaneously contact the tray when the tray has arrived at its approximate processing position. The position contact switches provide a positive indication that the tray has actually arrived under the control of the servo motor and encoder sensory feedback. These switches can thus signal any mechanical failure that prevents the tray from being properly positioned.

FIG. 4 also pictorially depicts a group independently operable nozzle banks 65, 66, 67 and their associated fluid supply lines 69, which are generally positioned below the horizontal plane of the container tray 17 and which are movable along an x-axis (represented by arrow denoted "A") from one end of the container tray to the other (as depicted by the phantom line representation of the nozzle banks). The x-axis movement of the nozzle banks permits a selected nozzle bank to be registered with the open mouth ends of the containers held in the tray, and more specifically with the precisely located nozzle access holes 37 in the tray insert over which the containers are supported. The nozzle banks, with their associated nozzle elements 71, 72, 73 and fluid supply lines, provide means for supplying a stream of fluid to the cleaning bay, and particularly to the inside of the containers when the nozzle banks are processed through the containers in a z-axis motion as hereinafter described. The fluids supplied to the nozzle banks are suitably supplied from a remote fluid reservoir (see FIG. 10) and may consist of a variety of fluids, including tap water, a nitric acid solution, de-ionized water, or air from a compressor for drying.

With reference to FIG. 4, it is noted that one or more additional spray elements (such as spray element 75) can suitably be provided overhead the container tray to provide an additional source of fluid spray to rinse the exterior surfaces of the containers 31. While it is contemplated that the interior surfaces of the containers will repetitively be processed through a series of cascaded cleaning bays using different solutions, an external spray need only be provided in selected bays as required to meet aesthetic cleanliness standards for the containers' non-critical exterior surfaces.

As best seen in FIGS. 4 and 5, fluids supplied through the bay's nozzle elements 71, 72, 73 and external spray element 75 fall into a catch basin 77 at the bottom of the cleaning bay which directs the fluids to a central drain 79 through which the fluids can be disposed of, recovered, and/or recycled. Splash guards are suitably provided within the cleaning bay to shield the cleaning bay's various operative parts from the fluids emitted by the bay's nozzle and external spray elements and for directing the fluids into the bay's catch basin.

As illustrated in FIG. 5, splash guards include a tray overhead splash guard 81 having opposed downwardly extending channel portions 83, 85 which shield outboard regions 87, 89 housing the moving parts of the nozzle banks, and which also shield inboard regions 91, 93 containing the support rails 25 for the tray and the upper horizontal path 50 of the tray's drive chain. It is further contemplated that vertical spray guards (not shown) will be disposed in front of the vertical portions of the chain. The various spray guards will have an eave effect which cause the splashing fluids within the bay to run down toward the catch basin for removal through the drain. Because there is no vigorous spray action outside of the spray emitted within the containers and the external spray emitted immediately below the tray overhead splash guard, the cleaning bay is able to contain and direct the fluids without the need for special sealing.

Figure 6:
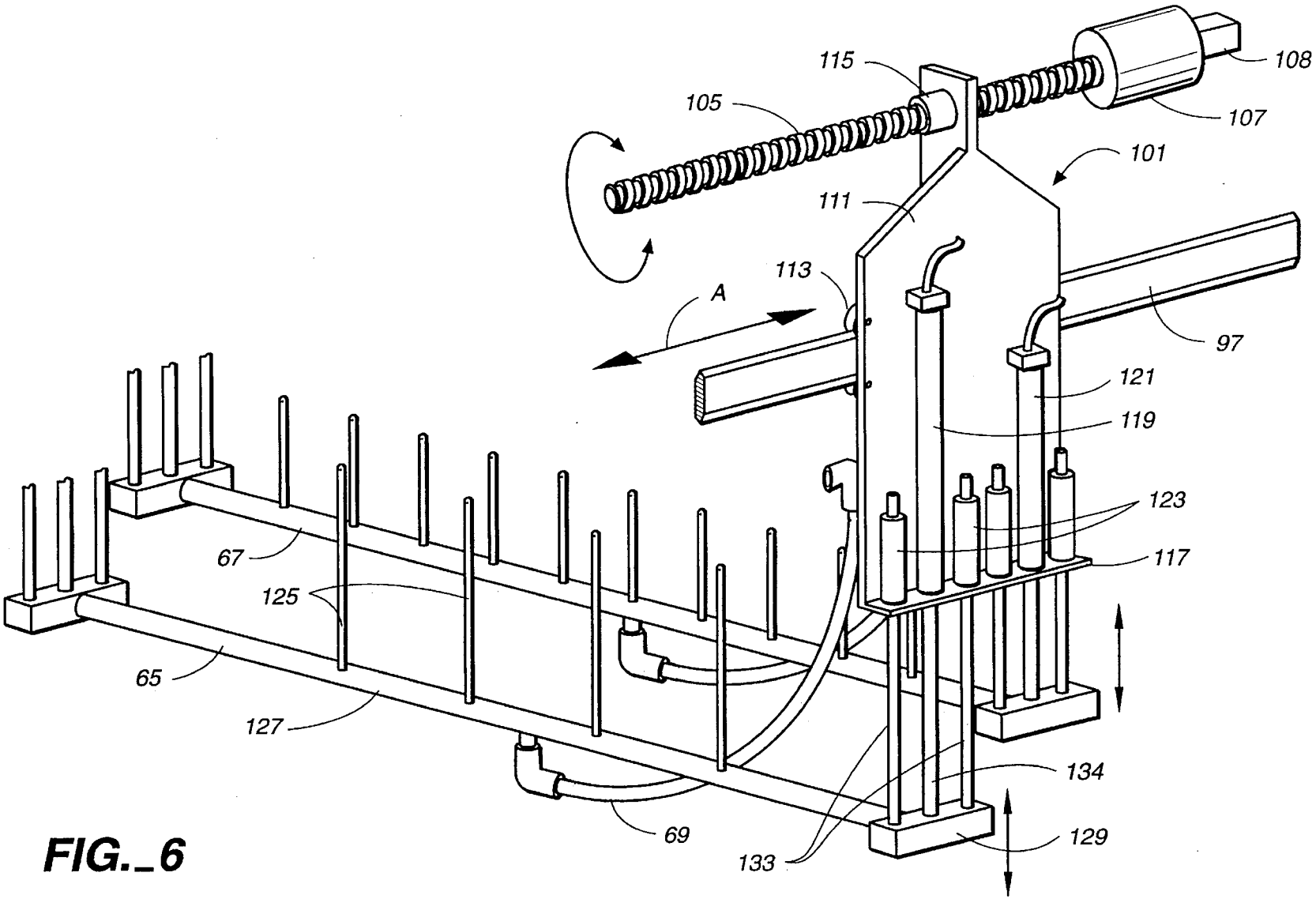
FIG. 6 is a perspective view of a nozzle bank and nozzle bank roller assembly and drive mechanisms.

The structure and deployment of the nozzle banks and the means for registering the nozzle elements of the nozzle bank with the inverted containers residing in the container tray are best illustrated in FIGS. 5 and 6. Before described these structures, it is preliminarily noted that FIG. 6 illustrates only the first and last one of the nozzle banks 65, 66, 67 diagrammatically illustrated in FIG. 4; the intermediate nozzle bank 66 has been omitted for clarity. It is understood that the number of nozzle banks will depend on the variety of container spacings that the apparatus is designed to accommodate.

The nozzle banks 65, 67 are carried on nozzle guide rails 95, 97 by means of roller assemblies 99, 101 that are driven along the guide rails by means of lead screws 103, 105 synchronously driven by stepper motors 107 operatively connected to the ends of each lead screw. Each roller assembly consists of a vertical carriage plate 111 having two V-roller pairs 113 and a lead screw drive collar member 115 secured to the inside of the plate, and a horizontal cylinder support ledge 117 extending from the plate's outside bottom edge. Each of the independently operable nozzle banks are retractably coupled to the carriage plate of each roller assembly by means of pneumatic cylinders and linear bearing blocks, such as the pneumatic cylinders 119, 121 and bearing blocks 123 mounted to the top of the support ledge 117 of the carriage plate as best shown in FIG. 6.

Each nozzle bank, for example nozzle bank 65, more specifically has a series of elongated nozzle elements 125 extending upwardly from a horizontal manifold 127 which receives a fluid supply through fluid supply lines 69. At each of its ends the manifold is connected via junction blocks 129 to the retractable plunger elements 134 of the pneumatic cylinders 119 and to the two straddling guide rods 133 of the associated bearing blocks 123. As the pneumatic cylinders 119, 121 raise and lower a nozzle bank as further described below, the bearing blocks will act to keep the nozzle bank aligned with the pneumatic cylinder to prevent binding of the plunger within the cylinder.

It can be seen that there are two critical motions of the nozzle banks. First is the x-axis motion in which the nozzle elements of a selected nozzle bank can be registered with the open mouth ends of the containers supported in a resident tray, and a z-axis motion which involves a means for generating a process cycle in which the nozzle elements are caused to traverse through the mouth end of the containers registered therewith. In other words, the z-axis motion of the nozzle banks cause the selected nozzle banks to cycle in a forward and return motion as depicted by the vertical arrows in FIG. 6 such that the tip of the nozzle elements travel through the container for a dwell time during which a direct, high pressure stream of fluid sweeps the interior surfaces of the containers. As shown in FIG. 5, Hall Effect sensors 135 are provided along one of the pneumatic cylinder pairs associated with each nozzle bank to provide a means of detecting the forward advance of the nozzle bank so that the nozzle bank's direction of travel can be reversed at a height programmed to correspond with the particular bottle size being processed. The Hall Effect sensors, which require the pneumatic cylinders to be adapted to provide a detectable magnetic field, provide a relatively easily implemented binary feedback system for regulating the nozzle elements' direction of travel. It shall be appreciated that other feedback systems could be used, including linear feedback systems that would permit greater control over the nozzle's travel and dwell time characteristics. For example, it might be desirable to have the nozzle elements dwell for a longer period of time at a certain region of the container where greater concentrations of impurities are normally found.

In FIG. 6 it can been seen that different nozzle banks are provided with nozzle elements of different lengths. Each of the nozzle banks will be selected for processing a different range of container sizes. With height indexing through feedback from the Hall Effect sensors 135, the nozzle banks will be able to accommodate a wide range of container sizes.

Figure 7A:
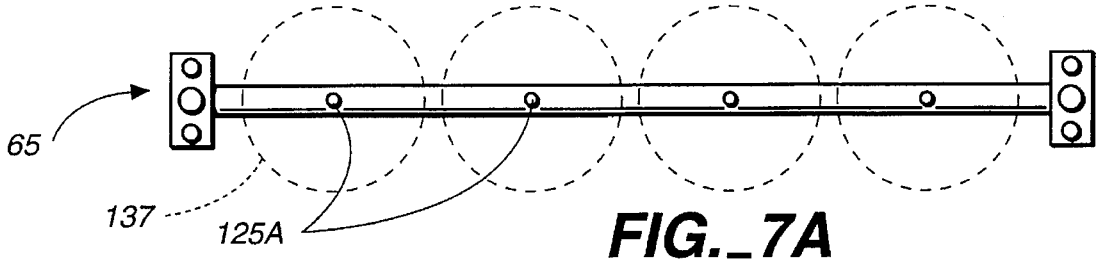
FIGS. 7A–7C are top plan views of three nozzle banks showing different nozzle element spacings relative to different diameter containers shown in phantom lines.
Figure 7B:
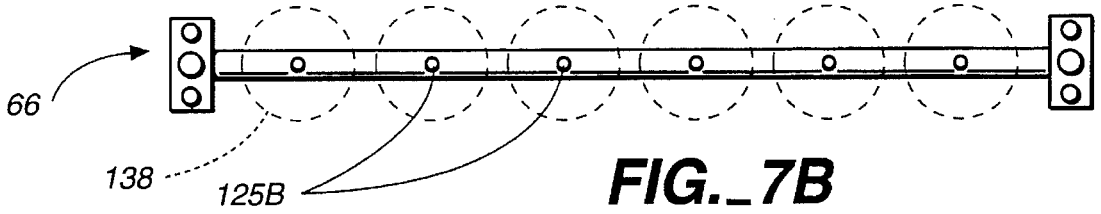
Figure 7C:
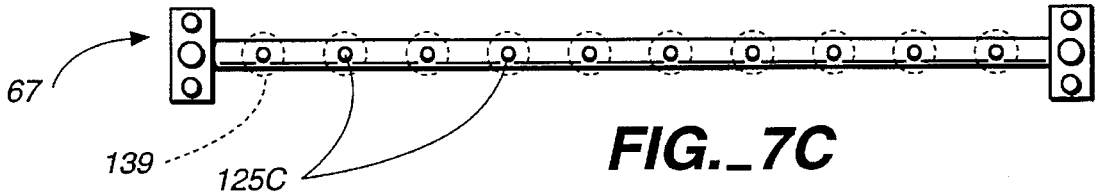

The provision for separate, independently operable nozzle banks also enhances the throughput capabilities of the apparatus. FIGS. 7A–7C show three nozzle banks 65, 66, 67 (corresponding to the nozzle banks 65, 66, 67 in FIG. 4) having nozzle elements 125A, 125B, 125C of three different spacings which accommodate containers 137, 138, 139 of three different diameters so as to optimize the packing density of the containers. As shown in FIG. 7A, large diameter containers 137 are processed by a nozzle bank having nozzle elements 125A of a relatively wide spacing whereas FIG. 7C shows a relatively narrow spacing for the nozzle elements 125C for processing relatively small diameter containers 139.

Figure 8A:
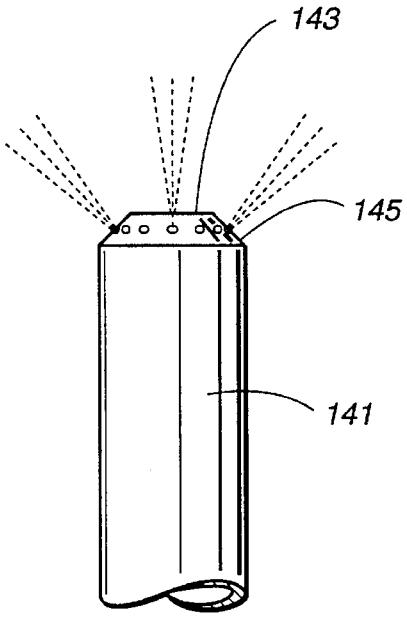
FIGS. 8A and 8B are fragmentary side elevational views of a nozzle element of the nozzle banks showing two alternative designs of the nozzle tip.
Figure 8B:
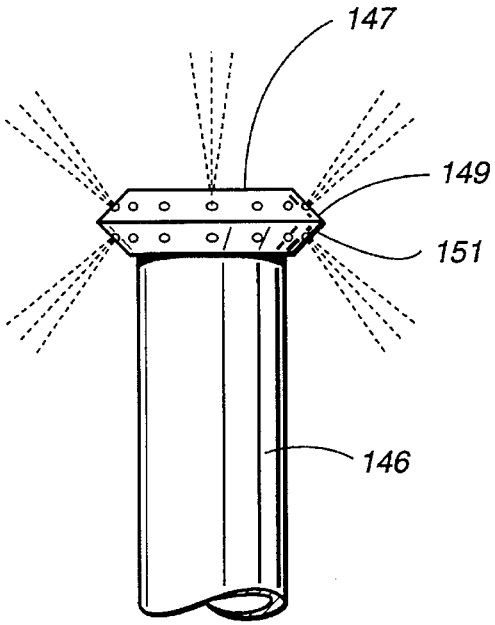

FIGS. 8A and 8C show yet another way in which the nozzle banks can be configured to meet different processing requirements: that is, by providing different nozzle tip designs for providing different spray patterns from the nozzle elements. For example, FIG. 8A shows a nozzle tip 141 having two spray emitting surfaces, a first emitting surface 143 which is a top surface for projecting a forward spray, and a second spray emitting surface 145 which is a forward facing angled surface for projecting a sideward spray. The nozzle tip 146 shown in FIG. 8B on the other hand has, in addition to a first top spray emitting surface 147, both a second spray emitter surface 149 which is a forward facing angled surface, and a third spray emitting surface 151 which is a rearward facing angled surface for projecting a rearward stream of fluid. The nozzle tip design of FIG. 8B would be particularly useful for narrow mouth containers having interior horizontal shoulder surfaces surrounding the mouth of the inverted container.

Thus, it can be appreciated that a wide variety of nozzle bank configurations can be provided to meet a wide variety of processing requirements involving different container sizes, shapes and materials. Processing requirements can be met by providing different selectable and independently operable nozzle banks as above-described, and by providing for exchangeable nozzle elements within a given nozzle bank. Regardless of the nozzle bank selected or the nozzle configuration used, the processing cycle will be the same for each nozzle bank.

Figure 9:
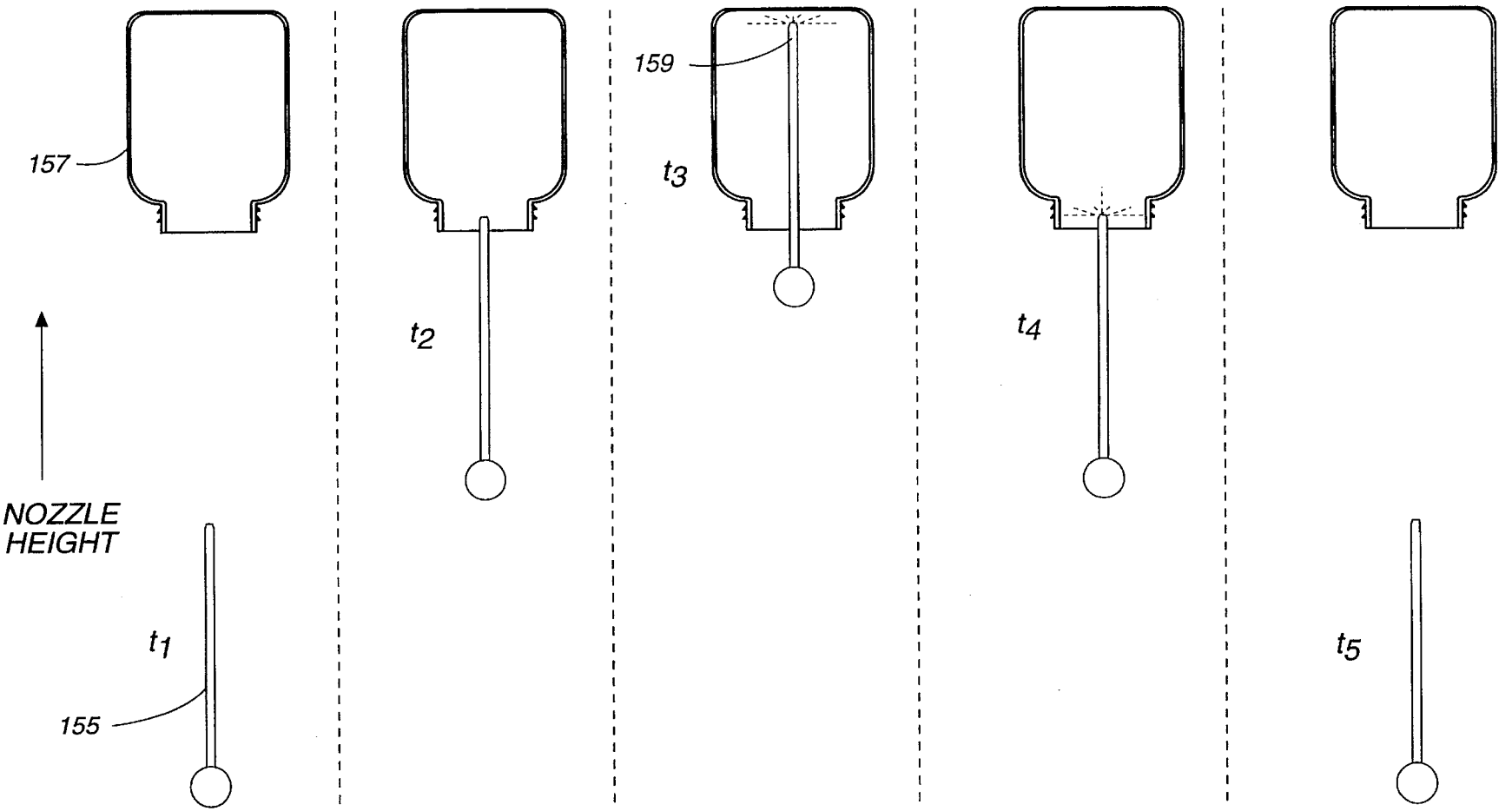
FIG. 9 is a diagrammatic representation of the process cycle of the nozzle bank wherein a nozzle element of the nozzle bank traverses through the open mouth end of an inverted container.

The processing cycle for a nozzle bank is illustrated in FIG. 9 wherein the movement of one nozzle element 155 of a nozzle bank relative to an inverted container 157 is shown at five different points in the cycle occurring at times $t_1$, $t_2$, $t_3$, $t_4$, and $t_5$. The beginning and end of the cycle occur at times $t_1$ and $t_5$ where the nozzle bank is fully retracted. At $t_3$ the tip 159 of the nozzle has advanced to its full desired height within the container as signalled by the Hall Effect sensors 135 on the pneumatic cylinder associated with the nozzle bank. With feedback from a selected Hall Effect sensor, the nozzle element is caused to reverse direction at $t_3$ so that it retracts to its starting position shown at $t_5$. Also, at $t_3$, fluid control means, operated under the control of the bay central processing unit (CPU) hereinafter described, initiates a fluid stream which remains on while the nozzle element retracts to the position shown at $t_4$, at which time the fluid stream is turned off. Thus, the fluid stream will sweep the interior surfaces of the container for the container's entire length and will only be activated inside of the container thereby conserving fluid and confining the reach of the fluids within the bay. Other sequences of turning the fluid stream on and off are possible, for example, initiating the fluid stream at $t_2$ when the tip of the nozzle element first enters the mouth of the container so as to sweep the container sides in both directions; however, initiating the stream at the height of the nozzle bank's travel minimizes fluid consumption and is a sequence readily implemented by a time-out circuit triggered by the Hall Effect sensor feedback.

The above-described process cycle is generated for a nozzle bank selected in accordance with the container size and type to be processed. It is repeated as the selected nozzle bank is moved into registration with each row of containers in the tray from the first row to the last row (see the diagrammatic representation of the nozzle banks in FIG. 4). The means for registering the nozzle elements of the nozzle bank with each row of containers can more specifically be described in reference to FIGS. 4–6, wherein it is seen that synchronous stepper motors 107 rotate the lead screws 103, 105 to precisely advance the nozzle banks carried on the roller assemblies 99 from a know "home" position. A lead screw encoder 108 is operatively connected to at least one of the lead screws to provide sensory feedback that indicates that the nozzle banks have actually moved to where they are supposed to be. If problems arise with any of the lead screw couplings, the effect on the positioning of the nozzle banks will be signaled by the encoder.

It should be noted that the home position of the nozzle banks would logically be at one end of the resident container tray or the other such that the nozzle banks move from a first row of containers to an end row. Preferably, the nozzle banks will successively home to both ends of the tray such that the nozzle bank first processes a tray of containers from a front row of containers to a back row and then processes the next tray of containers from a back row to a front row. Providing two home positions at either end of the tray eliminates the need for the nozzle bank to travel back the length of the container before the next tray can arrive, with the result that overall processing speed is increased.

Figure 10:
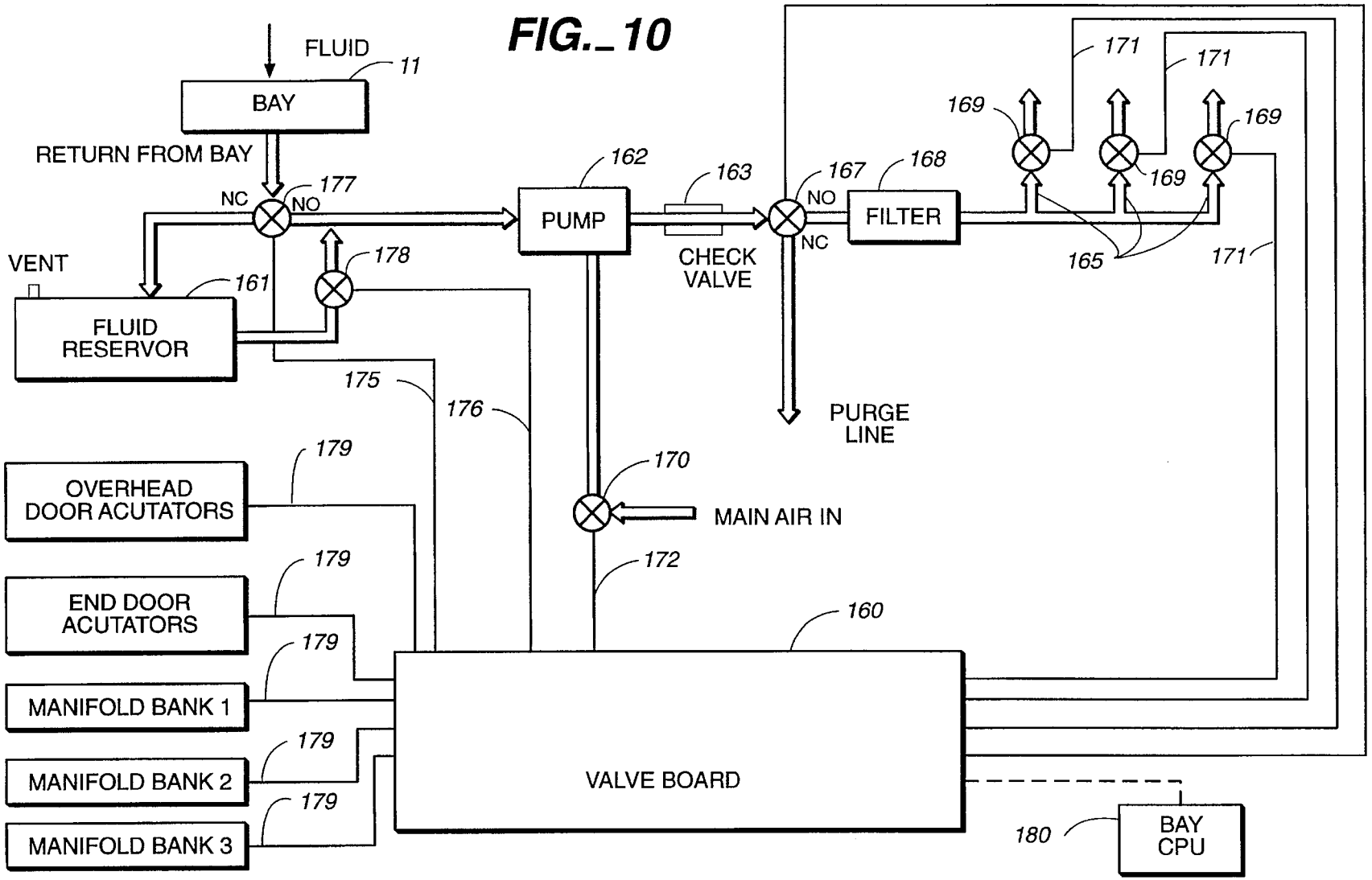
FIG. 10 is a generalized pneumatic and hydraulic circuit diagram generally illustrating the pneumatic and hydraulic controls of the cleaning bay.

FIG. 10 generally illustrates suitable hydraulic and pneumatic circuits for each cleaning bay which, under the control of the bay CPU 180, conduct fluids through the system, which operate the required control values—some of which are suitably located on a valve board 160 mounted to the bay—and which actuate the various air cylinders for closing bay doors and raising the nozzle banks. The fluids for the nozzle banks are supplied under pressure by pump 162 from a remote fluid reservoir 161 through a circuit which includes check valve 163, filter 168, fluid supply lines 165, and a three-way valve 167 used to purge the lines. The circuit also includes fluid control means for turning the fluid stream from the nozzle elements of the nozzle bank on and off. This fluid control means is in the form of two-way nozzle bank valves 169 which are actuated through control lines 171. Similar control lines 172, 175,176 actuate valves 170, 177, 178. Fluids captured in the bay's catch basin can be diverted by three-way valve 177 either back to the reservoir or to a recovery or waste treatment facility.

The air cylinders which raise and lower the nozzle banks, and the air cylinders for opening and closing the bay doors, including the end doors and the overhead maintenance door, if any, are actuated through suitable pneumatic feed lines 179 connected to a compressed air source through suitable pneumatic control valves or the valve board 160.

Figure 11:
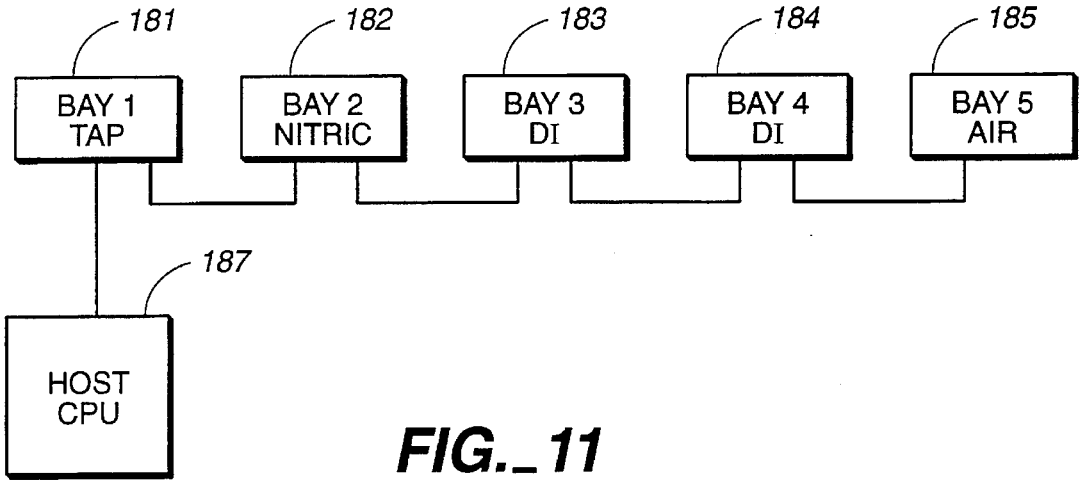
FIG. 11 is a block diagram showing five cleaning bays cascaded together under the supervision of a host central processing unit (CPU).
Figure 12:
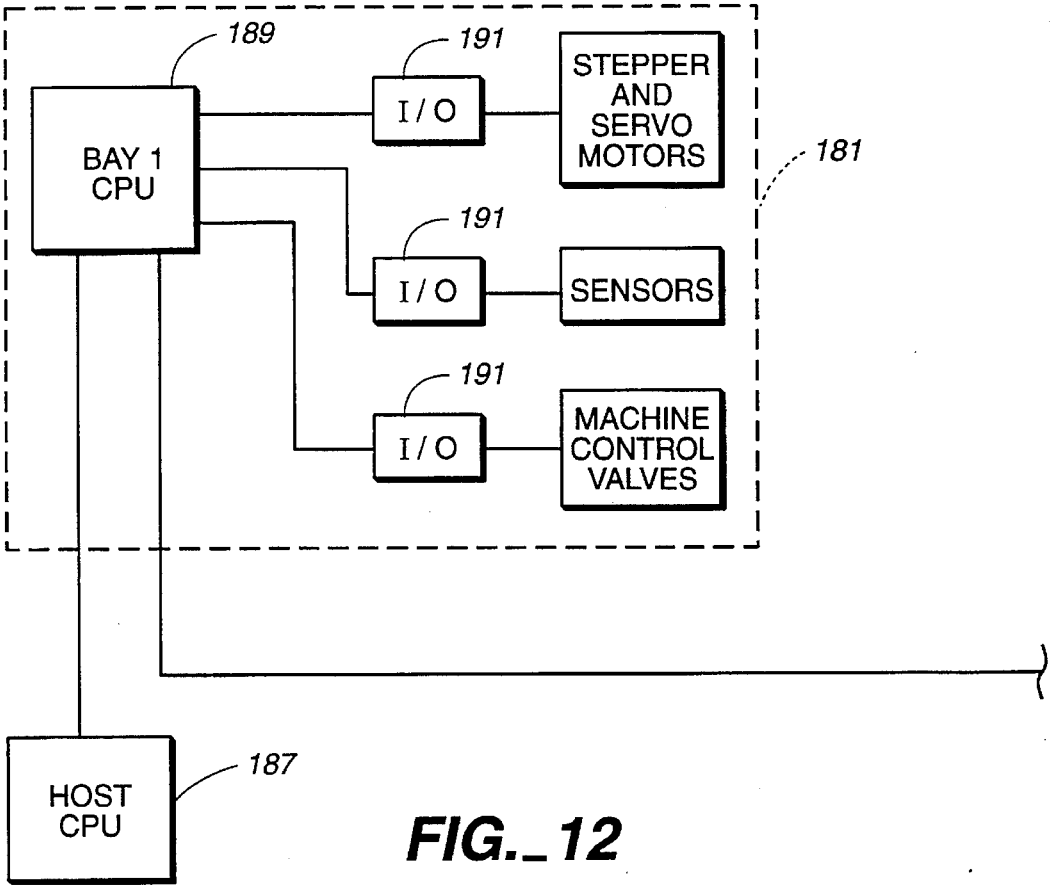
FIG. 12 is a block diagram illustrating the various input/output (I/O) requirements of each bay CPU.

FIGS. 11–12 generally illustrate the configuration by which cascaded cleaning bays are operated under the control of a host CPU and distributed bay CPUs, and FIGS. 14–19 are flow charts describing the software functions by which the host and bay CPUs communicate with each other, process bottle type information, and carry out the necessary machine control functions for processing successive container trays through multiple cleaning bays.

Referring to FIG. 11, five cleaning bays 181,182, 183, 184, 185 are shown cascaded together under the control of a host CPU 187. As earlier described, each bay processes the containers through selected cleaning and rinse solutions and can include one or more bays for air drying the containers. In FIG. 11, the sequence is a first bay 181 for tap water with detergent followed by three rinse bays 182, 183, 184 which, in turn, provide a nitric acid rinse and two de-ionized water rinses. The final bay 185 air dries the containers: in this bay the fluid stream emitted by the nozzle banks is air.

As shown in FIG. 12, each cleaning bay has its own local bay CPU 180 to provide local process control. The inputs and the outputs of the motors, sensors, and control valves of the bay are all handled by the bay CPU through suitable I/O ports 191. The bay CPUs for the cascaded bays are preferably daisy-chained together from the host CPU via a serial RS485 communications link for long distance control capabilities.

Figure 13:
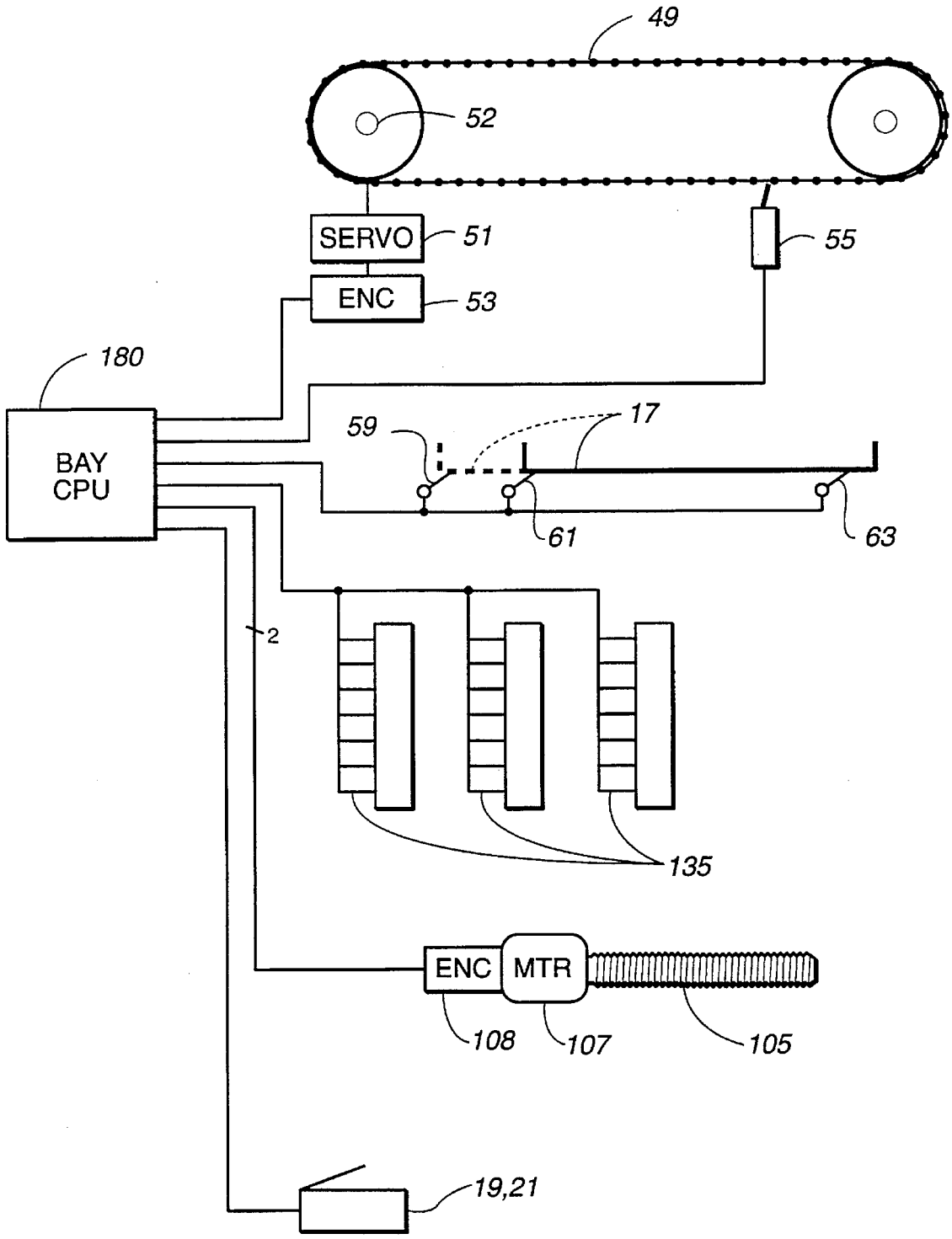
FIG. 13 is a pictorial illustration of the various sensor inputs to the bay CPU for each cleaning bay.

The sensor inputs for each bay CPU are diagrammatically illustrated in FIG. 13 wherein the bay CPU 180 is shown as receiving chain position information from the servo motor encoder 53 and from the chain's home position sensor 55; tray position information from the tray contact switches 59, 61, 63; nozzle bank height or z-axis position information from the Hall Effect sensors 135 on the air cylinder nozzle bank roller assembly; nozzle bank x-axis position from the lead screw encoder 108; an indication of the position of the end doors 19, 21 such as from suitably located contact switches (not shown).

The host and bay CPUs, each of which can suitably be based on a Motorola Z80 microprocessor and each of which has associated memory capacity suitable to its task, have a communication protocol below described which allows the host CPU to poll and send and receive information to and from the individual bay CPUs. This information will include container or bottle type information in a "look-up table" stored in the memory associated with the host CPU. The bottle type look-up table is accessible by the bay CPUs to obtain container height, spacing, and row count criteria for selecting one of the independently operable nozzle banks, for establishing the height of travel of the selected nozzle bank, and for setting the parameters under which the nozzle banks are advanced by the lead screw. Operator access to the host CPU is through a suitable keyboard and display terminal. As described below, the operator, in addition to designating bottle types to be processed, can through keyboard commands also edit the bottle type look-up table to add, delete or change bottle type information. It is understood that programming the CPUs to carry out the functions and capabilities herein described can be accomplished by persons of ordinary skill in the programming arts using routine programming techniques.

Turning to the flow charts of FIGS. 14–19, it is first noted that communications between the host CPU and remote bay CPUs is packet driven, that is, the host CPU continually sends out data packets to the bay CPUs with an address byte which tells which of the bay CPUs it is talking to. The data packets, which may be 20 to 30 bytes long, are capable of addressing the bay CPUs as to their status and the type of container being processed. The bay CPU responds by sending a corresponding data packet back to the host CPU, with the information conveyed by the return packet being reflected on the host's display terminal. If a data packet is not returned, a malfunction of a bay CPU would be evident, at which time the operator can shut down the machine.

Figures 14, 14A:
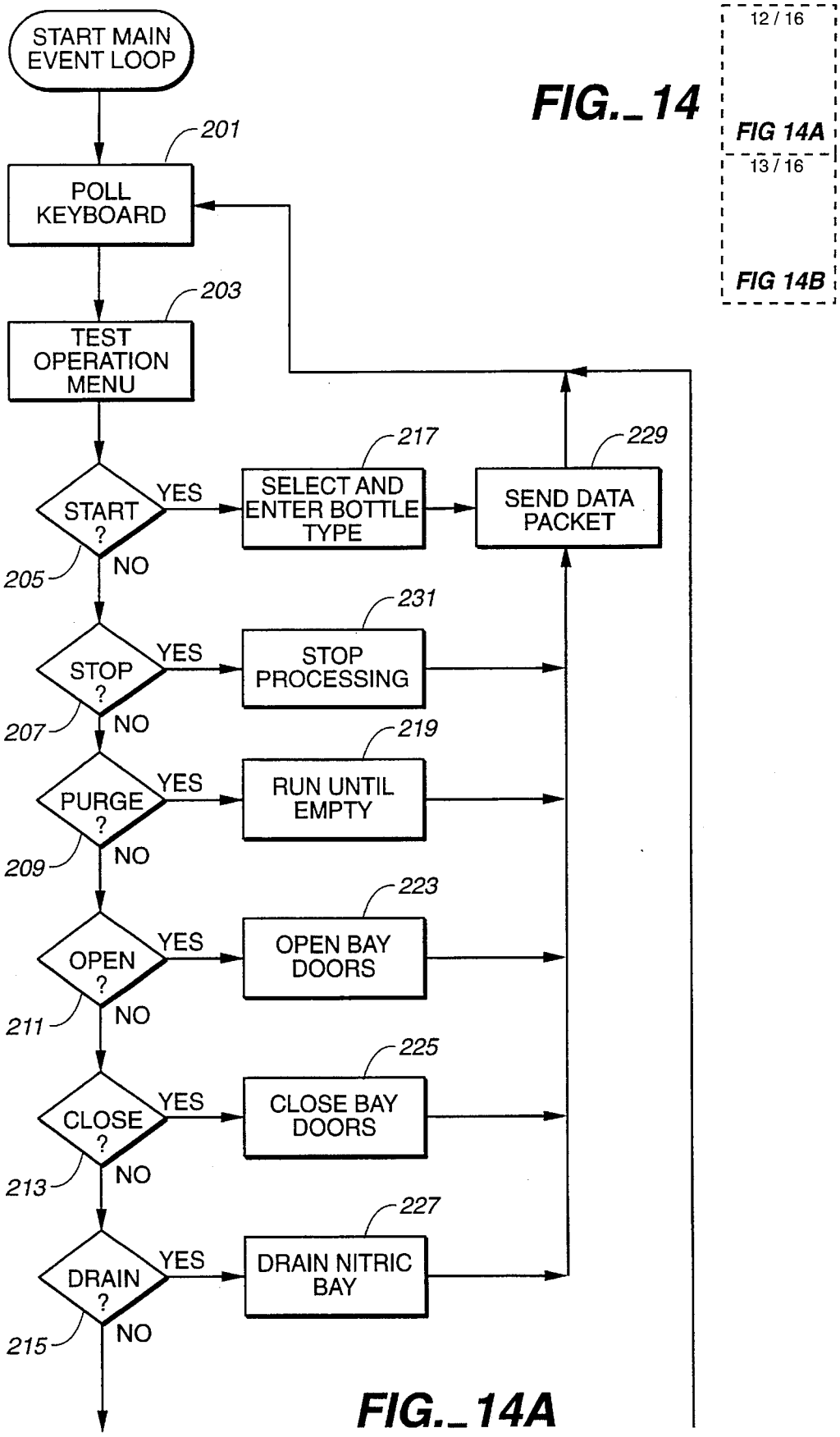
FIGS. 14, 14A and 14B show a flow chart illustrating the operator control features of the host CPU.
Figure 14B:
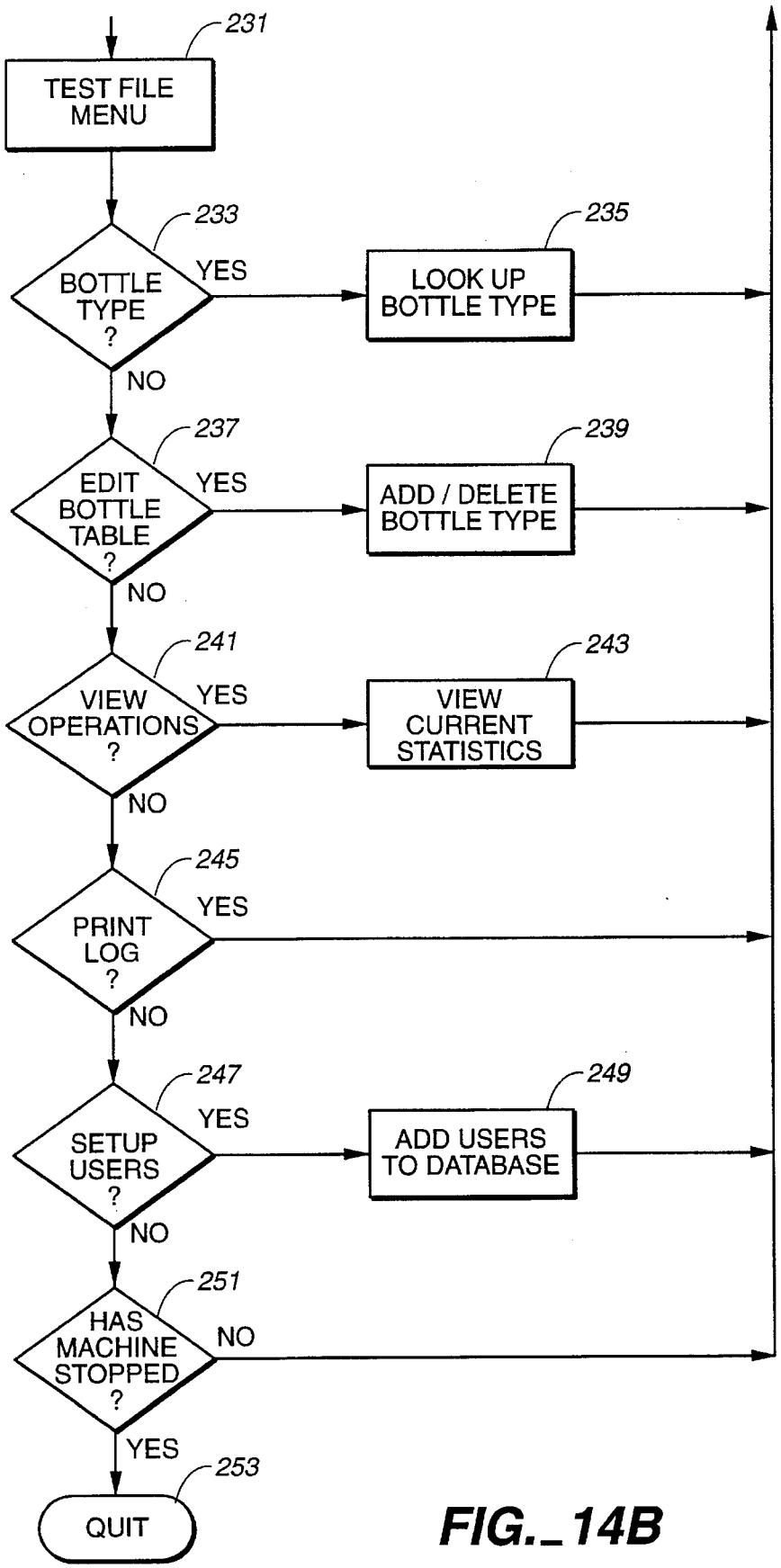

FIGS. 14A and 14B show the main event loop of the host computer in which keyboard commands by an operator are processed by a keyboard polling routine (block 201 ). The first level of commands is a "Test Operation" screen menu (block 203) in which operator can enter the commands "Start", "Stop", "Purge", "Open", "Close", "Drain" (blocks 205,207,209, 211, 213, 215), or other suitable commands all of which cause a data packet (block 229) to be circulated to the bay CPUs. The host processes the keyboard commands (blocks 217, 219, 221, 223, 225, 227) by sending a data packet to the bay CPUs or by taking the operator to a secondary "Test File" menu (block 231) shown in FIG. 14B. From the "Test File" menu the operator can input container (bottle) type information (block 232, 235), edit bottle type information (blocks 237, 239), or initiate other operational functions such as viewing current processing statistics relative to previous processing runs (e.g., the number and types of bottles processed in a given time period) (blocks 241, 243). The "Test File" menu also includes a print command (block 245), and a command for adding users to the system by establishing additional user codes (blocks 247, 249). The screen menu program routines will continuously monitor whether the machine has stopped, and will quit when it has (blocks 251,253).

Figure 15:
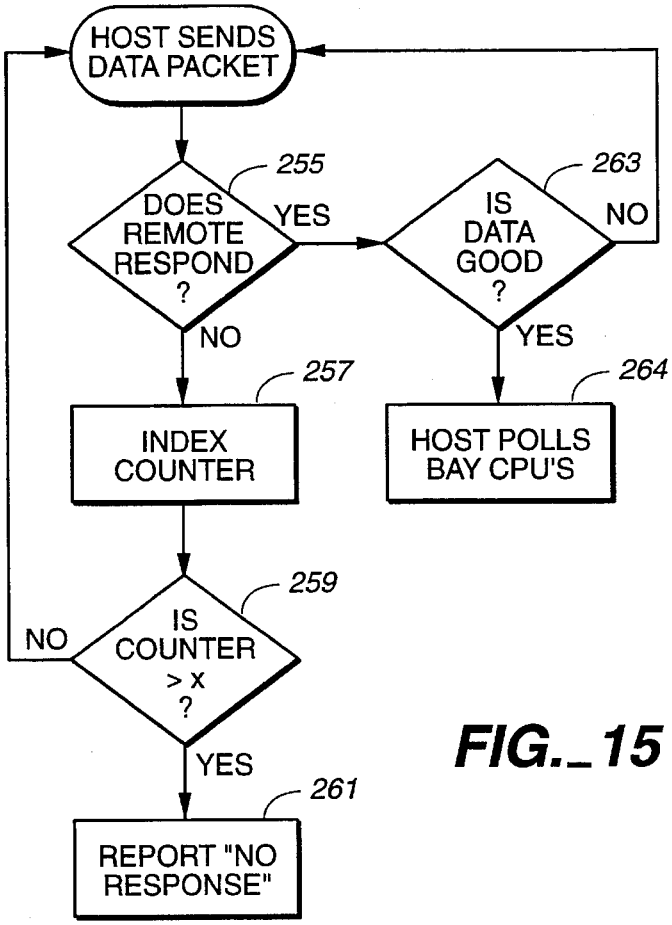
FIG. 15 is a flow chart illustrating the procedure by which the host CPU communicates with the individual bay CPUs.

FIG. 15 generally illustrates the communications routine needed by the host CPU to insure that remote bay CPUs properly receive data packets from the host. This routine tests whether the remote CPU responds within a certain number of tries as determined by a counting routine (blocks 255, 257, 259); if after an "x" number of attempts the addressed CPU does not respond, the host reports a "no response" (block 261) to the operator for appropriate action such as shut down. Preferably an emergency "STOP" switch (not shown) is provided in the event a host "Stop" command (block 207 of FIG. 14A) is not operative.

The host communication routine can also test the data received back from the CPU to determine if the data is good by using suitable known error checking procedures (blocks 263, 264).

Figure 16:
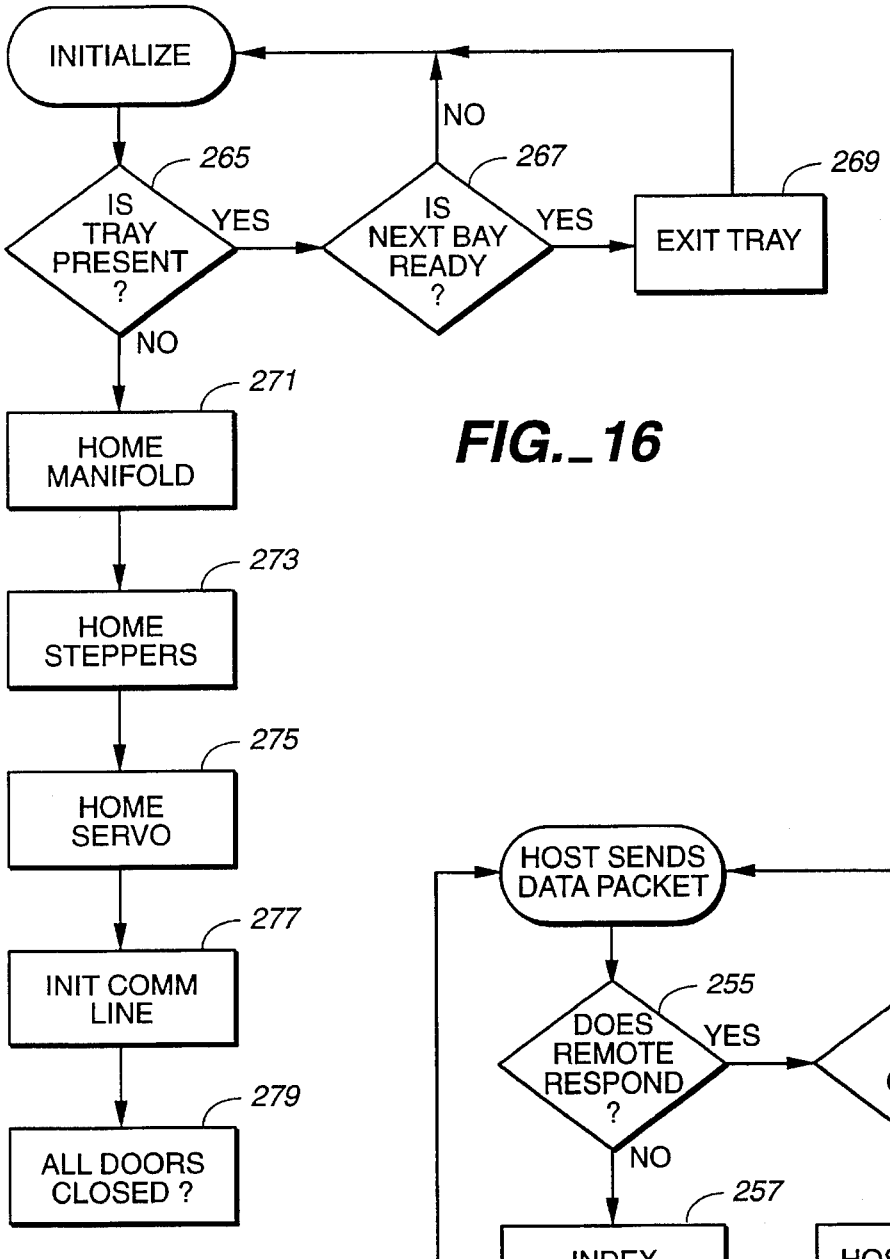
FIG. 16 is a flow chart illustrating the basic initialization function of the bay CPU.
Figure 17:
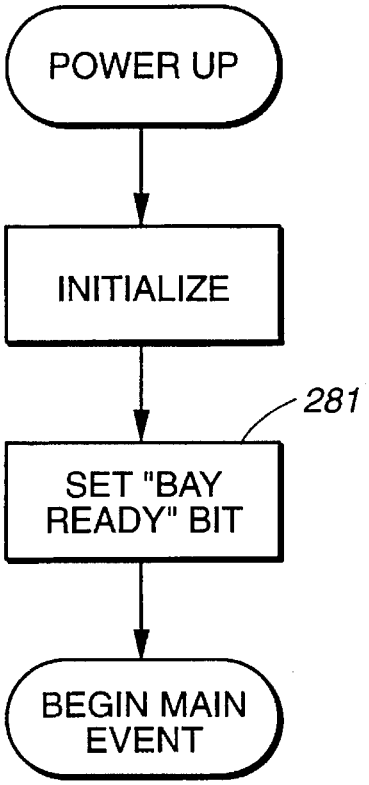
FIG. 17 is a flow chart that illustrates the basic power up sequence of the bay CPUs.

FIGS. 16–19 illustrate the programmed functions of the bay CPUs. As shown in FIGS. 16 and 17 each bay is initialized upon power up. As shown in FIG. 16, initialization involves first testing to see if a tray is resident within the bay and if it is to determine if the next bay in the sequence of cascaded bays is ready to receive the tray (blocks 265, 267). Assuming the next bay is prepared to receive a tray (i.e., it does not have a resident tray of its own) or the bay is the last bay, the tray is exited through the out feed end of the bay (block 269). Once the bay is cleared, the CPU directs the bay to move the nozzle banks and drive chain to their home positions in reference to the various above-described sensor inputs (blocks 271, 273, 275). The communication lines to the host CPU are also initialized (block 277), and the condition of the bay end doors (and top maintenance door, if any) tested (block 279). The bay CPU of the initialized cleaning bay then indicates it is ready to receive a new container tray by setting a bay ready bit.

Figure 19:
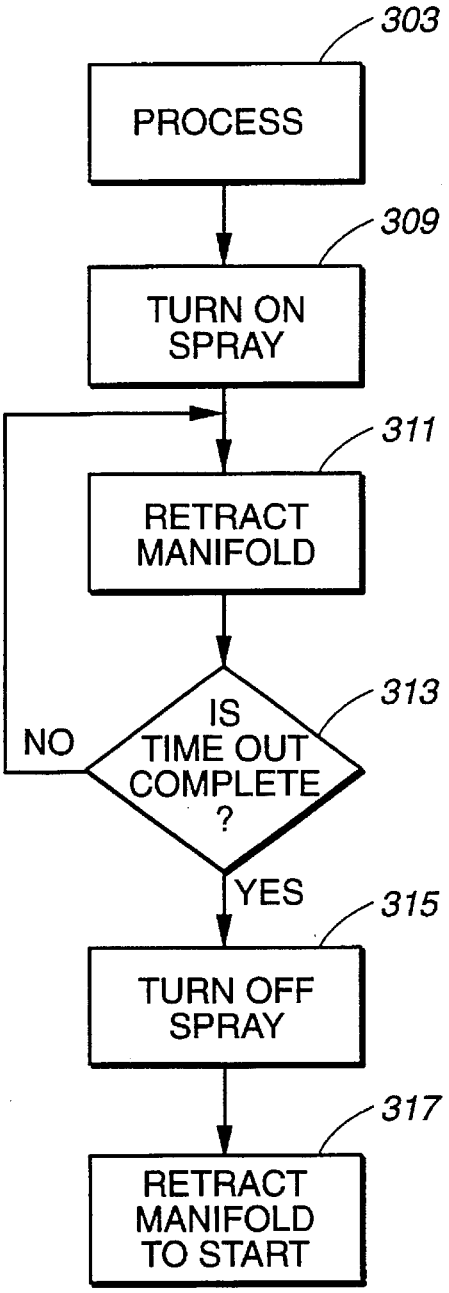
FIG. 19 is a flow chart illustrating the process by which the fluid stream from the nozzle elements is turned on and off.
Figure 18:
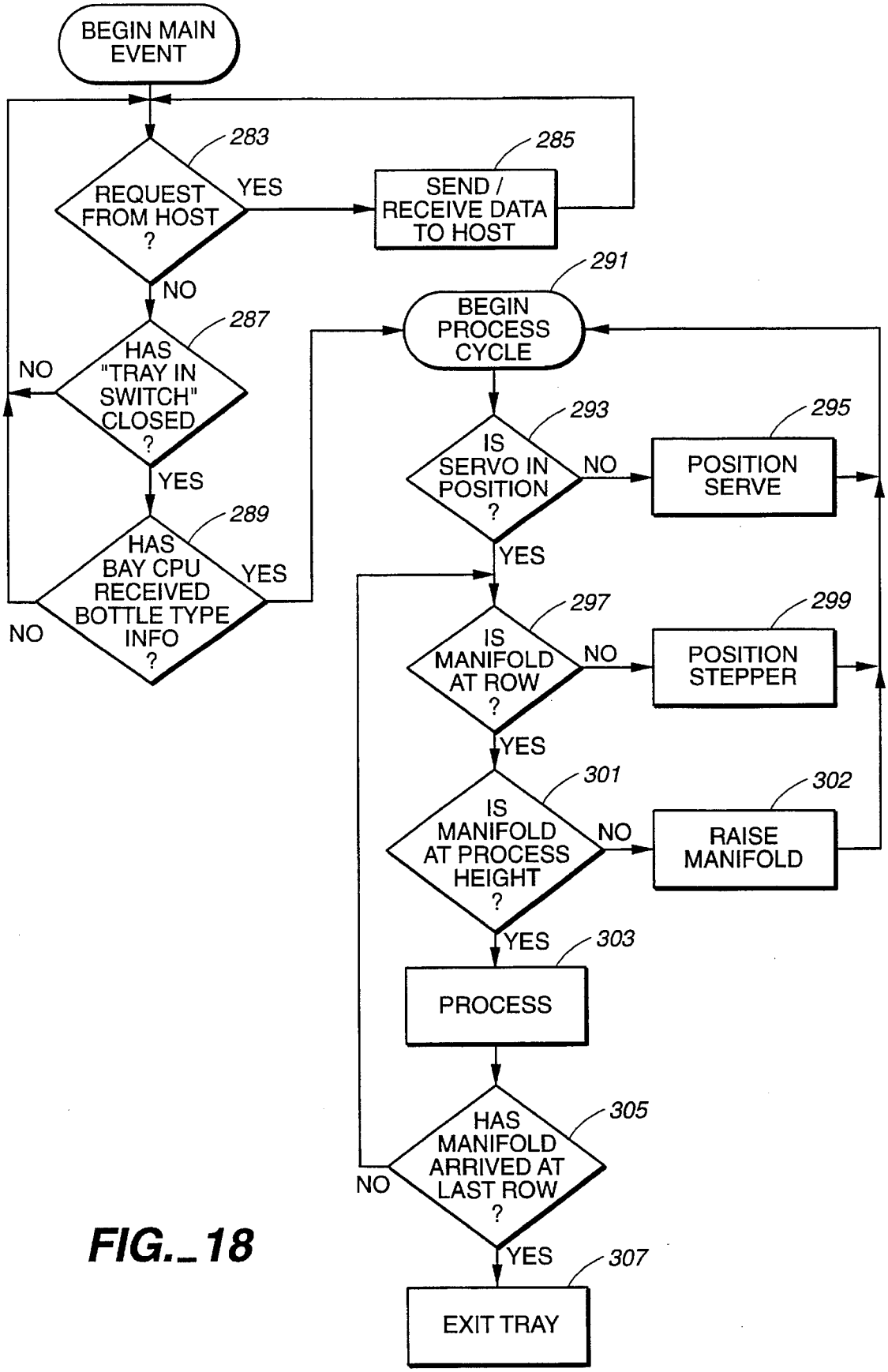
FIG. 18 is a flow chart illustrating the basic operating sequences of each bay CPU in controlling the positioning and movement of the tray and nozzle bank by which the nozzle elements of the nozzle bank are cycled through the containers held by the tray.

The bay ready bit signals to the bay CPU that it can begin the main event loop shown in FIGS. 18 and 19 for processing the tray of containers (see block 281 of FIG. 17). In the main event loop, the CPU continually looks for and responds to data packets (requests) from the host CPU as represented by blocks 283 and 285. It also tests to see if a tray has arrived in the bay from sensory feedback from the tray position contact switches (block 287). Once a tray has arrived, the CPU checks to see if it has received from the host the necessary bottle type information to process the bottles arrayed in the tray (block 289), and, once the information has been received, initiates the process cycle illustrated in FIG. 9 for each row of containers held in the tray (block 291).

The process cycle routine begins by establishing from sensory feedback from the servo encoder 53 that the tray has been properly positioned (block 293). If the tray is not in position, it actuates the drive chain's servo motor 51 to correct the position (block 295). The lead screw stepper motor 107 is then actuated to position a selected nozzle bank (manifold) in registration with the first row of containers supported in the tray (blocks 297, 299; also see FIG. 4). The air cylinders on the nozzle bank roller assembly are then actuated to raise the selected nozzle bank to a height determined by the bottle type information received by the bay CPU from the host's CPU's look-up table (blocks 301, 302). When the nozzle bank reaches its designated process height the tips of the nozzle elements will be inserted substantially entirely within the inverted row of bottles being processed at which point the bottles are processed (block 303) as generally illustrated in FIG. 19.

The process routine shown in FIG. 19 is part of the fluid control means by which the fluid of the cleaning bay is turned on and off at the right times. The fluid stream is turned on (block 309) when the nozzle bank is at its maximum height. At this time retraction of the nozzle bank back to its home z-axis position commences (block 313) and after a suitable time-out the fluid stream is turned off (blocks 313, 315). Preferably, the time-out occurs just as the nozzle elements exit the bottles. The time-out interval for the fluid stream can be established by a time circuit from the known rate of travel of the nozzle bank and the height of the bottles as reflected in the bottle type look-up tables. Following time-out of the fluid stream, the nozzle bank continues to retract to its home or start position (block 317).

Processing a row of bottles as above-described is repeated for each row until the nozzle bank arrives at the last row (block 305 of FIG. 18), at which point the tray is exited from the bay (block 307) after the end doors are opened and after it is determined that the next bay, if any, can receive a tray. A tray exited from one bay can be picked up by the next bay by extending the tray support rails between bays and by suitably spacing the bays such that a tray handed off by the drive chain of one bay is picked up by the drive chain of the next bay. Modular bays according to the invention can thusly be cascaded together in any desired number and sequence.

It shall be appreciated that processing the tray of containers in accordance with the invention can be accomplished by means of process steps other than the steps described above. For example, the time out of the fluid stream may be triggered at a point in the z-axis cycle of the nozzle bank other than its maximum height. The fluid stream might alternatively be turned on as the nozzle elements first enter the mouth of the bottle such that the fluid stream sweeps the bottles' interior surfaces in both directions of travel. Actuation of the fluid can also be accomplished by means other than a time out circuit, such as by turning the fluid both on and off from sensory feedback from the Hall Effect sensors.

Therefore, it can be seen that the present invention provides an apparatus and method for cleaning containers in which a direct and consistent fluid stream sweeps substantially the entirety of the containers' interior surfaces to thoroughly clean these surfaces in accordance with strict standards, such as those set by the EPA for environmental sampling containers. The apparatus and method is particularly adapted to batch processing and provides a batch processing method that increases throughput over conventional hand washing and rinsing methods presently used. The invention has the additional advantage of flexibility, in that, it can be adapted to processing different sizes and types of containers and provides for modular units or bays which can be cascaded together in a desired washing and rinsing sequence. While the present invention has been described in considerable detail in the foregoing specification, it is understood that it is not intended that the invention be limited to such detail, except as necessitated by the following claims.

What we claim is:

1. A modular apparatus for cleaning containers having an open mouth end comprising at least two modular cleaning bays, said modular cleaning bays being interchangeably cascaded together and including a first bay and end bay, transporting means for transporting a set of inverted containers along a defined container support plain and in a predetermined spaced relationship successively into each modular cleaning bay from said first bay to said end bay, said transport means including a container support tray for holding a set of containers in an inverted position and in a predetermined spaced relationship, continuous guide rails longitudinally extending through each of said modular cleaning bays for movably supporting said container support tray as said support tray advances from cleaning bay to cleaning bay and for holding said container support tray in position within each of said cleaning bays, and support tray drive means associated with each cleaning bay for picking up said container support tray, for positionably moving said container support tray on said guide rails within said cleaning bay, and for exiting the support tray from said cleaning bay, fluid stream supply means for supplying a selected cleaning fluid to each one of said cleaning bays, said fluid stream supply means having at least one nozzle bank disposed within each of said modular cleaning bays below said container support plain, each of said nozzle banks having a set of elongated nozzle elements arranged in correspondence with the spaced relationship of the set of inverted containers transported into said bays, means in each modular cleaning bay for registering the nozzle elements of said nozzle bank for said bay with a set of containers transported into said bay, means in each modular cleaning bay operative over a defined nozzle bank process cycle for cycling the nozzle bank in said bay in a forward and return movement that causes said set of nozzle elements to traverse through the mouth ends of a set of containers registered therewith, and fluid control means for each modular cleaning bay for activating the bay's fluid stream supply means such that a fluid stream is emitted from said set of nozzle elements when said nozzle elements traverse through a set of containers registered therewith, the support tray drive means for each of said cleaning bays including position feedback means for precisely positioning said container support tray within its associated cleaning bay during at least one nozzle bank process cycle, each of said cascaded cleaning bays being fluidly isolated from its adjacent cleaning bays to prevent cross-contamination of fluids.

2. The apparatus of claim 1 wherein said container transporting means includes means for holding a set of containers in aligned rows, wherein the nozzle elements of the nozzle bank of each of said cleaning bays are arranged in at least one row corresponding to the aligned rows of containers supported within said cleaning bays, and wherein said nozzle registration means for each of said cleaning bays includes nozzle bank drive means for advancing said nozzle bank into successive registration with row of containers of said set of containers for a process cycle.

3. The apparatus of claim 1 wherein said fluid stream supply means includes at least two nozzle banks within each of said modular cleaning bays, the nozzle banks within each of said cleaning bays being independently operable for cleaning different container sizes.

4. A method of cleaning containers having an open mouth end comprised of the steps of transporting a set containers in an inverted position into and out of successive cascaded cleaning bays, each of said cleaning bays being fluidly isolated from and interchangeably connected to its adjacent cleaning bay and each of said cleaning bays having at least two independently operable sets of nozzle elements for emitting a fluid stream of a selected solution, said sets of nozzle elements being adapted to clean different sized containers, in each cleaning bay, supporting the set of containers transported into the cleaning bay generally above the set of nozzle elements in said cleaning bay, in each cleaning bay, operatively selecting a set of nozzle elements depending on the size of the set of containers being processed, registering the set of nozzle elements in each cleaning bay with the mouth ends of the set of inverted containers supported therein, and in each cleaning bay, cycling said set of nozzle elements in a forward and return movement to cause said nozzle elements to traverse through the mouth ends of the set of containers registered therewith to provide direct fluid stream of a selected solution to inside surfaces of said containers.

* * * * *

UNITED STATES PATENT AND TRADEMARK OFFICE

CERTIFICATE OF CORRECTION

PATENT NO. : 5,566,695

DATED : October 22, 1996

INVENTOR(S) : Levey et al.

It is certified that error appears in the above—identified patent and that said Letters Patent is hereby corrected as shown below:

Col. 14, line 31, Claim 2, add "each" before "row".

Signed and Sealed this

Twenty-fifth Day of March, 1997

Bruce Lehman

*Attest:*

BRUCE LEHMAN

*Attesting Officer*

*Commissioner of Patents and Trademarks*